US005826626A

United States Patent [19]

Huemer

[11] Patent Number: 5,826,626

[45] Date of Patent: Oct. 27, 1998

[54] WEFT THREAD MONITORING SYSTEM IN A CIRCULAR LOOM

[75] Inventor: Franz Starlinger Huemer, Vienna, Austria

[73] Assignee: Starlinger & Co. Gesellschaft mbH, Vienna, Austria

[21] Appl. No.: 793,808

[22] PCT Filed: Sep. 19, 1995

[86] PCT No.: PCT/AT95/00183

§ 371 Date: Mar. 5, 1997

§ 102(e) Date: Mar. 5, 1997

[87] PCT Pub. No.: WO96/12839

PCT Pub. Date: May 2, 1996

[30] Foreign Application Priority Data

Oct. 20, 1994 [CH] Switzerland ..... 3150/94

[51] Int. Cl.[6] ..... D03D 51/34; D03D 37/00

[52] U.S. Cl. ..... 139/371; 139/459; 242/912; 226/11; 112/273; 66/161

[58] Field of Search ..... 139/459, 371; 242/148, 912; 226/11; 112/273; 66/161, 163

[56] References Cited

U.S. PATENT DOCUMENTS

| | | | |
|---|---|---|---|
| 2,711,759 | 6/1955 | Low et al. | 139/459 |
| 4,234,021 | 11/1980 | Clokie | 139/371 |
| 4,361,172 | 11/1982 | Tori | 139/371 |
| 4,422,402 | 12/1983 | Ogihara | 111/67 |
| 4,616,681 | 10/1986 | Huemmer | 139/371 |

FOREIGN PATENT DOCUMENTS

| | | | |
|---|---|---|---|
| 387 797 | 10/1989 | Austria | 139/459 |
| 861171 | 10/1940 | France | 139/371 |
| 1 224 216 | 9/1966 | Germany | 139/459 |
| 489 641 | 6/1970 | Switzerland | 139/459 |
| 717948 | 11/1954 | United Kingdom | 139/459 |
| 2 015 592 | 9/1979 | United Kingdom | 139/459 |

*Primary Examiner*—Andy Falik
*Attorney, Agent, or Firm*—Hoffmann & Baron, LLP

[57] ABSTRACT

A device for monitoring a weft in a circular loom where the weft is drawn-off from a bobbin of the weaving shuttle rotating along a circular path formed by a circular reed. The device includes a magnetic sensor stationarily arranged in a zone of the circular path of the weaving shuttle for generating an electronic control signal to turn off the loom when there is a fault in the weft creating an operative connection between the magnetic sensor and a permanent magnet. The magnet is carried by the weaving shuttle. The device has a pivoting lever having the permanent magnet arranged thereon. The device also includes a return spring that displaces the pivoting lever as well as the permanent magnet attached thereon towards a position where the operative connection between the magnetic sensor and the permanent magnet is made. During the normal operation of the circular loom, the weft being drawn-off holds the permanent magnet against the influence of the return spring outside of the position where the operative connection is made.

14 Claims, 4 Drawing Sheets

WEFT THREAD MONITORING SYSTEM IN A CIRCULAR LOOM

BACKGROUND OF THE INVENTION

1. Field of the Invention

The present invention relates to a device for monitoring wefts in a circular loom which are wound off from the respective bobbin of the weaving shuttles rotating in the weaving shed along a circular path formed by the circular reed and are delivered to the fabric edge of the woven hose, whereby a scanning means monitors the respective weft in order to generate an electric control signal in case of a weft fault.

2. Description of Prior Art

Circular looms are generally known in which a plurality of sectional shafts are arranged in a circular way around the circular reed of the machine and each carry a plurality of inner and outer harnesses for guiding a part of the two circularly distributed warp assemblages which are subjected to an opposing upwardly and downwardly alternate movement for forming the weaving or walking shed via a rotating main shaft. The weaving shuttles rotatingly driven by the main shaft in the circular reed deliver the weft to be drawn off from the respectively entrained bobbin continuously to the walking shed. The woven hose thus produced is then drawn off and wound up as a flat circular fabric.

In this respect it is essential that the proper presence of the wefts to be drawn off from the bobbins of the rotating shuttles is monitored as carefully as possible in order to control the machine in a respective way for preventing weaving faults, e.g. by turning it off immediately in case of weft faults which may be caused by breakage of the weft or exhaustion of the weft bobbin.

Known devices of this kind use, among other things, photooptical sensing elements in which the photocell is activated by a reflecting surface pivoting into the light beam. Such light barriers, however, can no longer meet current requirements, particularly in view of the considerably increased revolving speeds of the weaving shuttles and the generation of precise control signals.

Light barriers have always been susceptible to influences by external light, become easily dusty and do not allow any processing of reflex ribbons owing to "blinding".

SUMMARY OF THE INVENTION

It is thus the object of the present invention to provide a device for monitoring the wefts in a circular loom which is not subject to the disadvantages of the known state of the art.

This is achieved at first in accordance with the invention in that the electric control signal is producable by a magnetic sensor which is arranged in the zone of the revolving path of the weaving shuttles and which cooperates with a permanent magnet carried by the respective weaving shuttle, whereby the permanent magnet is arranged on a pivoting lever deflected by the drawn-off weft against the effect of spring-like return means and is held outside of the operative connection with the magnetic sensor in order to reach, in case of a weft fault, under the influence of the return means its end position producing an operative connection of the permanent magnet with the magnetic sensor for generating an active control signal.

Such a device is neither subject to any influence by external light, nor to any malfunctions through dust accumulation or to any wear and tear. This device, however, allows the processing of reflex ribbons, works securely at any revolving speed of the shuttles and is provided with a very high response sensitivity and response speed.

In order to reduce the revolving path of the affected shuttle with its permanent magnet to the magnetic sensor to a few angular degrees it is advantageous to arrange on the reed or the like a plurality of such magnetic sensors distributed over the circumferential direction.

A simple and functionally entirely secure arrangement can be achieved furthermore in that the pivoting lever carrying the permanent magnet at its free end is arranged with its pivoting axle on the thread insertion apparatus of the shuttle and is under the influence of a return spring, whereby the drawn-off weft penetrates or at least partly wraps around an end section at the free end of the pivoting lever or that the pivoting lever carrying the Permanent magnet at its free end is arranged with its pivoting axle on the rotational axle of the weft bobbin and is under the influence of a return spring, whereby the drawn-off weft penetrates or at least partly wraps around an end section at the free end of the pivoting lever.

Exemplified embodiments of the subject matter of the invention are explained below by reference to the drawings.

BREIF DESCRIPTION OF THE DRAWINGS

FIG. 1 shows a circular loom in a side view and in a schematic representation;

FIG. 2 shows a partial view of a weaving shuttle with the device in accordance with the invention for monitoring the wefts of the arrangement in accordance with FIG. 1 on an enlarged scale, and FIG. 3 shows a partial top view of a weaving shuttle with the device in accordance with the invention for monitoring the wefts of the arrangement in accordance with FIG. 1 on an enlarged scale, and FIG. 4 shows an embodiment of the arrangement in accordance with FIGS. 2 and 3 in a side view and on an enlarged scale.

DETAILED DESCRIPTION OF THE PERFERRED EMBOBIMENTS

Figure 1:
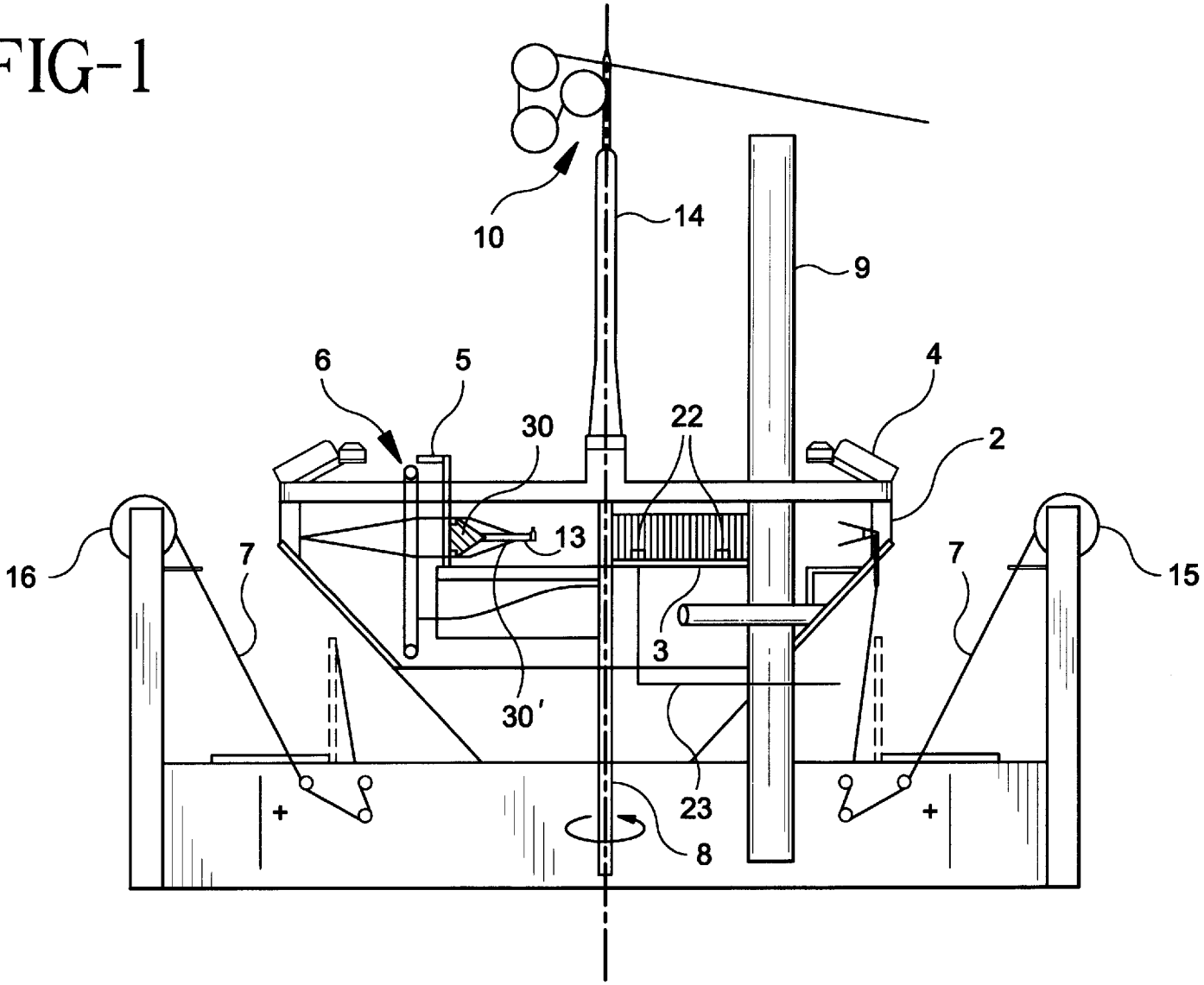
Figure 2:
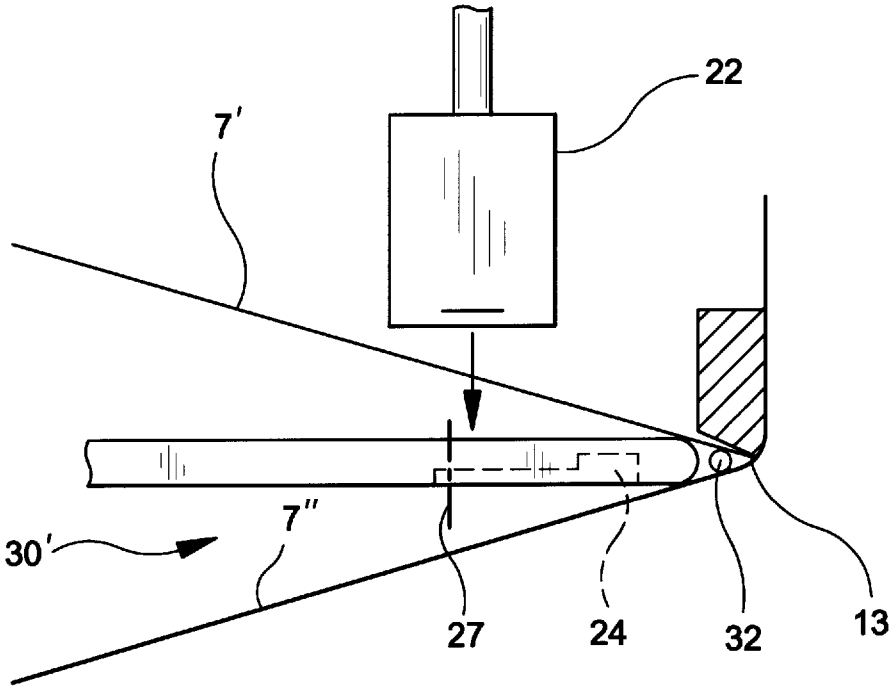

The circular loom in accordance with FIG. 1 rests in the usual manner on the basic frame 1 of the machine, on which a circular frame carrier 2 rests, which carries the circular reed 3, the "on" and "off" button 4 for the machine and furthermore frame parts 5 for supporting the shafts 6. These shafts 6 are arranged in the known way around the main shaft 8 of the machine and form to a substantial extent the shed-forming means of the machine. The fabric draw-off apparatus rests further on basic frame 1 of the carriers 9, which is indicated herein only by fabric draw-off rollers 10. A fabric expander 14 is also effective in the draw-off zone. The drawing further shows in the circular loom the drawing-in roller 15 for the ends on the left and the drawing-in rollers 16 for the ends on the right. Said ends 7, whose course is only indicated, are divided into two circularly arranged warp assemblages and are drawn off in the known way by groups of warp bobbins (not shown in closer detail). For forming the weaving shed one of these assemblages is then lifted, whereas the other is guided from the level of the weaving plane downwardly through the so-called shed changing movements, so that a warp thread upper shed 7' and a warp thread lower shed 7" arises (FIGS. 2 and 4). In this so-called weaving or walking shed at least one, but usually several shuttles 30 with a weft bobbin 31 (FIG. 4) revolve on a horizontal circular path. As a result of the circular movement of the shuttles, the weft 32 (FIGS. 2, 3 and 4) wound off from the weft bobbin is delivered to the fabric edge 13 of the produced woven hose, so that said weft can be weaved into the fabric. The woven hose can then be drawn off upwardly and can be laid into a flat circular fabric.

To this point the arrangement of the circular loom as outlined above can coincide with the known state of the art, so that any further explanation of such a machine can be omitted.

The problem to be treated herein in such a circular loom consists of monitoring as carefully and functionally secure as possible the wefts 32 drawn off from the bobbins 31 of the revolving shuttles 30 in order to be able to control the machine accordingly by means of a generated control signal 23 in case of a weft fault.

It is provided in accordance with the invention for this purpose that the electric control signal 23 can be generated by a magnetic sensor 22 arranged in the zone of the revolving path of the weaving shuttles 30, which sensor cooperates with a permanent magnet 24 carried by the respective weaving shuttle 30. The permanent magnet is arranged on a pivoting lever 26 deflected by the drawn-off weft 32 against the effect of spring-like return means 25 and is held outside of the operative connection with the magnetic sensor in order to reach, in case of a weft fault, under the influence of the return means 25 its end position producing an operative connection of the permanent magnet with the magnetic sensor for generating an active control signal 23.

It is further provided to arrange in the zone of the revolving path of the weaving sheds, preferably on reed 3, a plurality of magnetic sensors 22, as is indicated in FIG. 1.

Figure 3:
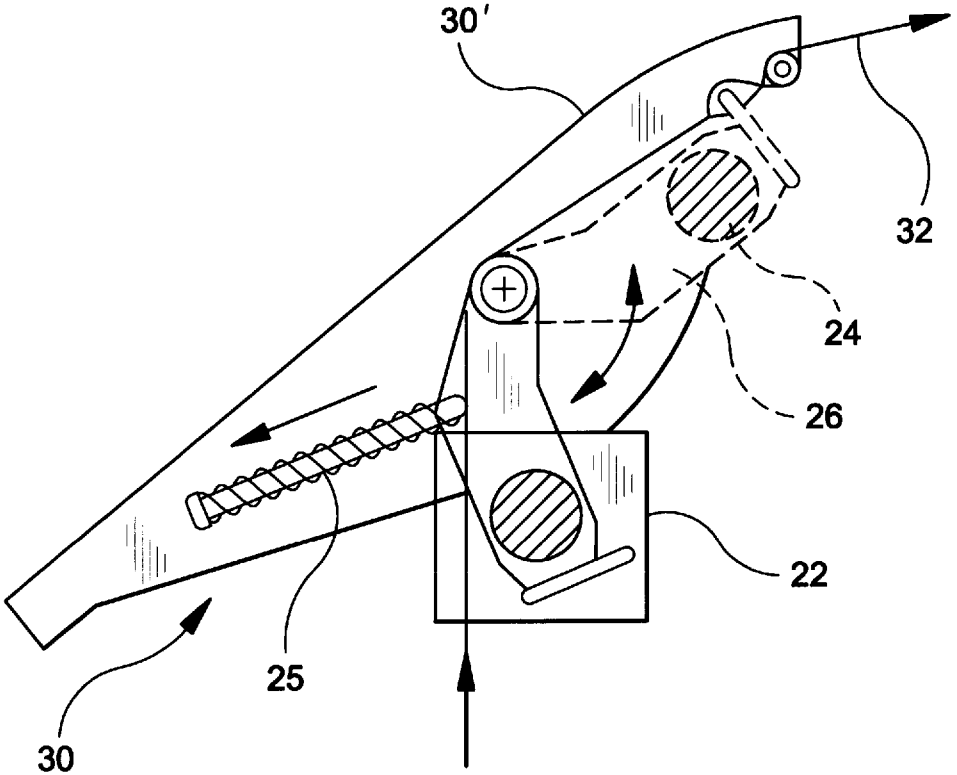
Figure 4:
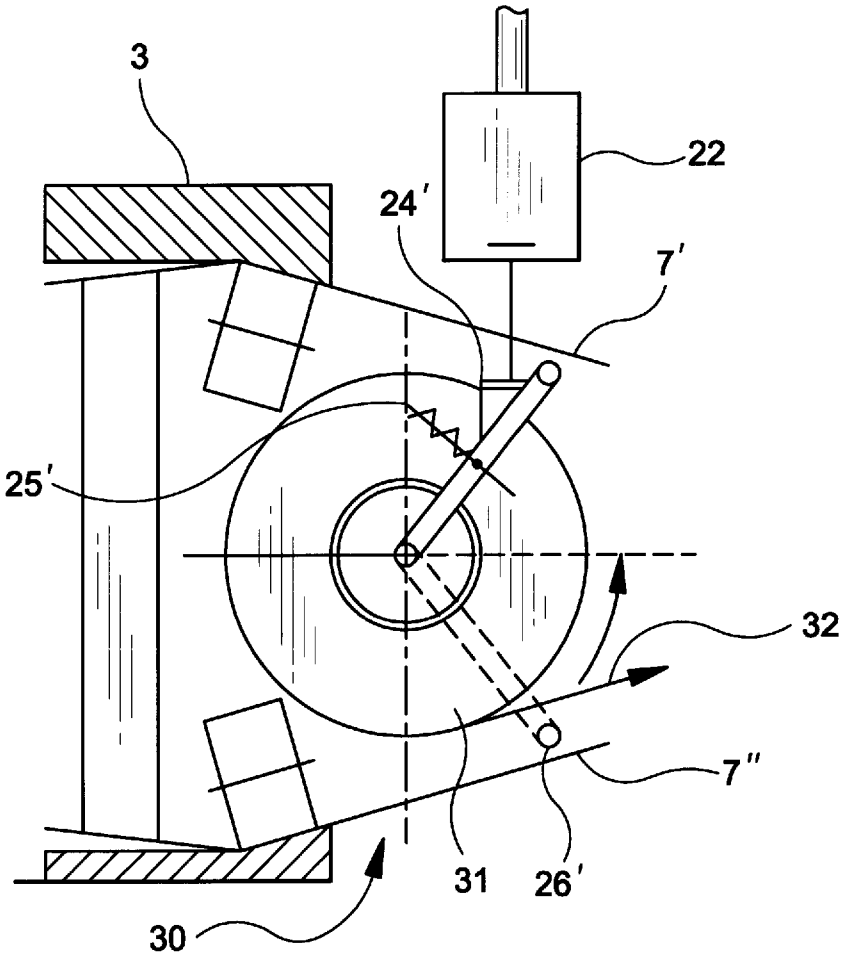

As is shown in FIGS. 2 and 3 in closer detail, the pivoting lever 26 carrying the permanent magnet 24 at its free end is arranged with its pivoting axle 27 on the thread insertion apparatus 30' on the shuttle 30 and is under the influence of a return spring 25, whereby the drawn-off weft penetrates an end section at the free end of pivoting lever 26 or wraps around it at least partially.

Alternatively in accordance with FIG. 4, the pivoting lever 26' carrying the permanent magnet 24' at its free end can be arranged with its pivoting axle 27' on the rotational axle of the weft bobbin 31 and be under the influence of a return spring 25', whereby here too the drawn-off weft penetrates an end section at the free end of pivoting lever 26' or wraps around it at least partially.

Where the circular loom includes several shuttles as described above, the circular loom includes a plurality of permanent magnets 24 which are associated with and carried by the plurality of weaving shuttles 30 and a plurality levers 26 on which said plurality of permanent magnets 24 are arranged. Each of the plurality of pivoting levers carries the plurality of permanent magnets at its free end.

The above results in a device in accordance with the invention for monitoring the wefts in a circular loom which meets all the requirements as mentioned above. In particular, the aforementioned measures allow an easy conversion of already existing machines as well as the use of weft monitoring devices in other thread-processing machines.

It is understood that modifications can be made to the device mentioned above without departing from the inventive idea, in particular the pivoting lever can be returned also under the influence of its own weight or the centrifugal force.

What is claimed is:

1. A circular loom having a device for monitoring wefts, said circular loom comprising:

a weaving shed;

a circular reed located in said weaving shed and forming a circular path;

a plurality of weaving shuttles which rotate along said circular path;

a plurality of bobbins associated with said weaving shuttles, each of the wefts being wound off from a respective one of said plurality of bobbins and being delivered to a fabric edge of a woven hose;

a scanner which monitors the wefts in order to generate an electronic control signal in case of a weft fault, said scanner including:

a magnetic sensor which generates said electronic control signal and which is stationarily arranged in a zone of said circular path of said plurality of weaving shuttles;

a plurality of permanent magnets which are associated with and carried by said plurality of weaving shuttles, a plurality of pivoting levers on which said plurality of permanent magnets are arranged; and a plurality of return springs configured to move said plurality of pivoting levers, wherein said plurality of pivoting levers are deflected by the wefts being drawn-off against an effect of said plurality of return springs and said plurality of permanent magnets are held outside of an operative connection with said magnetic sensor, and when in case of a weft fault said effect of said plurality of return springs causes at least one of said plurality of permanent magnets to displace to an end position of said plurality of permanent magnets producing said operative connection of at least one of said plurality of permanent magnets with said magnetic sensor for generating said electric control signal.

2. A circular loom as defined in claim 1, further comprising a plurality of magnetic sensors, said plurality of magnetic sensors being equally spaced along said zone of said circular path of said plurality of weaving shuttles.

3. A circular loom as defined in claim 1, wherein each of said plurality of pivoting levers include a free end, an end section and a pivoting axle, and each of said plurality of weaving shuttles include a thread insertion apparatus, wherein each of said plurality of pivoting levers carries said plurality of permanent magnets at said free end and is arranged with said pivoting axle on said thread insertion apparatus and is under said effect of said plurality of return springs, wherein each of the wefts being drawn-off penetrates said end section at said free end of each of said plurality of pivoting levers.

4. A circular loom as defined in claim 1, wherein each of said plurality of pivoting levers include a free end, an end section and a pivoting axle, and each of said plurality of weaving shuttles include a thread insertion apparatus, wherein each of said plurality of pivoting levers carries said plurality of permanent magnets at said free end and is arranged with said pivoting axle on said thread insertion apparatus and is under said effect of said plurality of return springs, wherein each of the wefts being drawn-off partly wraps around said end section at said free end of each of said plurality of pivoting levers.

5. A circular loom as defined in claim 1, wherein each of said plurality of pivoting levers include a free end, an end section and a pivoting axle, and each of said plurality of bobbins include a rotational axle, wherein each of said plurality of pivoting levers carries said plurality of permanent magnets at said free end and is arranged with said pivoting axle on said rotational axle and is under said effect of said plurality of return springs, wherein each of the wefts being drawn-off penetrates said end section at said free end of each of said plurality of pivoting levers.

6. A circular loom as defined in claim 1, wherein each of said plurality of pivoting levers include a free end, an end section and a pivoting axle, and each of said plurality of bobbins include a rotational axle, wherein each of said plurality of pivoting levers carries said plurality of permanent magnets at said free end and is arranged with said pivoting axle on said rotational axle and is under said effect of said plurality of return springs, wherein each of the wefts being drawn-off partly wraps around said end section at said free end of each of said plurality of pivoting levers.

7. A device for monitoring a weft in a circular loom, the weft being drawn-off from a bobbin of a weaving shuttle having a thread insertion apparatus and rotating along a circular path formed by a circular reed, said monitoring device comprising:

a pivoting lever having a free end and an end section adapted to be penetrated by the weft being drawn-off, said pivoting lever being adapted to be pivotally connected to the thread insertion apparatus of the weaving shuttle;

a permanent magnet, said permanent magnet being carried by said pivoting lever at said free end;

a return spring having an influence to displace said pivoting lever towards an end position; and a magnetic sensor stationarily arranged in a zone of the circular path of the weaving shuttle for generating an electronic control signal to turn off the loom when there is a fault in the weft creating an operative connection with said permanent magnet, wherein said permanent magnet is held outside of said operative connection by the weft being drawn-off against said influence of said return spring, and when there is a fault in the weft said influence of said return spring causes said pivoting lever to displace to said end position whereby said permanent magnet creates said operative connection with said magnetic sensor.

8. A device for monitoring a weft in a circular loom as defined in claim 7, further comprising a plurality of magnetic sensors, said plurality of magnetic sensors being equally spaced along the zone of the circular path of the weaving shuttle.

9. A device for monitoring a weft in a circular loom, the weft being drawn-off from a bobbin of a weaving shuttle having a thread insertion apparatus and rotating along a circular path formed by a circular reed, said monitoring device comprising:

a pivoting lever having a free end and an end section adapted to be partly wrapped around by the weft being drawn-off, said pivoting lever being adapted to be pivotally connected to the thread insertion apparatus of the weaving shuttle;

a permanent magnet, said permanent magnet being carried by said pivoting lever at said free end;

a return spring having an influence to displace said pivoting lever towards an end position; and a magnetic sensor stationarily arranged in a zone of the circular path of the weaving shuttle for generating an electronic control signal to turn off the loom when there is a fault in the weft creating an operative connection with said permanent magnet, wherein said permanent magnet is held outside of said operative connection by the weft being drawn-off against said influence of said return spring, and when there is a fault in the weft said influence of said return spring causes said pivoting lever to displace to said end position whereby said permanent magnet creates said operative connection with said magnetic sensor.

10. A device for monitoring a weft in a circular loom as defined in claim 9, further comprising a plurality of magnetic sensors, said plurality of magnetic sensors being equally spaced along the zone of the circular path of the weaving shuttle.

11. A device for monitoring a weft in a circular loom, the weft being drawn-off from a bobbin of a weaving shuttle rotating along a circular path formed by a circular reed, the bobbin having a rotational axle, said monitoring device comprising:

a pivoting lever having a free end and an end section adapted to be penetrated by the weft being drawn-off, said pivoting lever being adapted to be pivotally connected to the rotational axle of the weft bobbin of the weaving shuttle;

a permanent magnet, said permanent magnet being carried by said pivoting lever at said free end;

a return spring having an influence to displace said pivoting lever towards an end position; and a magnetic sensor stationarily arranged in a zone of the circular path of the weaving shuttle for generating an electronic control signal to turn off the loom when there is a fault in the weft creating an operative connection with said permanent magnet, wherein said permanent magnet is held outside of said operative connection by the weft being drawn-off against said influence of said return spring, and when there is a fault in the weft said influence of said return spring causes said pivoting lever to displace to said end position whereby said permanent magnet creates said operative connection with said magnetic sensor.

12. A device for monitoring a weft in a circular loom as defined in claim 11, further comprising a plurality of magnetic sensors, said plurality of magnetic sensors being equally spaced along the zone of the circular path of the weaving shuttle.

13. A device for monitoring a weft in a circular loom, the weft being drawn-off from a bobbin of a weaving shuttle rotating along a circular path formed by a circular reed, the bobbin having a rotational axle, said monitoring device comprising:

a pivoting lever having a free end and end section adapted to be partly wrapped around by the weft being drawn-off, said pivoting lever being adapted to be pivotally connected to the rotational axle of the weft bobbin of the weaving shuttle;

a permanent magnet, said permanent magnet being carried by said pivoting lever at said free end;

a return spring having an influence to displace said pivoting lever towards an end position; and a magnetic sensor stationarily arranged in a zone of the circular path of the weaving shuttle for generating an electronic control signal to turn off the loom when there is a fault in the weft creating an operative connection with said permanent magnet, wherein said permanent magnet is held outside of said operative connection by the weft being drawn-off against said influence of said return spring, and when there is a fault in the weft said influence of said return spring causes said pivoting lever to displace to said end position whereby said permanent magnet creates said operative connection with said magnetic sensor.

14. A device for monitoring a weft in a circular loom as defined in claim 13, further comprising a plurality of magnetic sensors, said plurality of magnetic sensors being equally spaced along the zone of the circular path of the weaving shuttle.

* * * * *